US009678456B1

(12) United States Patent
Iwasaki

(10) Patent No.: US 9,678,456 B1
(45) Date of Patent: Jun. 13, 2017

(54) IMAGE FORMING UNIT AND IMAGE FORMING APPARATUS

(71) Applicant: FUJI XEROX CO., LTD., Tokyo (JP)

(72) Inventor: Jin Iwasaki, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/072,435

(22) Filed: Mar. 17, 2016

(30) Foreign Application Priority Data

Dec. 7, 2015 (JP) ..... 2015-238201

(51) Int. Cl.
*G03G 15/08* (2006.01)

(52) U.S. Cl.
CPC ..... *G03G 15/0822* (2013.01)

(58) Field of Classification Search
CPC ..... G03G 15/0225
See application file for complete search history.

(56) References Cited

U.S. PATENT DOCUMENTS 2,297,691 A * 10/1942 Carlson ..... G03G 5/08207 101/467
5,128,725 A * 7/1992 Frankel ..... G03G 21/0035 15/256.5
5,765,076 A * 6/1998 Ogata ..... G03G 15/0225 399/100
2007/0134019 A1* 6/2007 Ando ..... G03G 15/0258 399/100
2008/0292354 A1* 11/2008 Shinkawa ..... G03G 15/0225 399/100
2010/0247135 A1* 9/2010 Imaizumi ..... G03G 15/0233 399/100
2016/0320738 A1* 11/2016 Tawada ..... G03G 21/0005
2016/0342129 A1* 11/2016 Matsumoto ..... G03G 21/0011
2016/0342134 A1* 11/2016 Shiori ..... G03G 15/5008

FOREIGN PATENT DOCUMENTS

JP 60156084 A * 8/1985
JP H09-179375 A 7/1997
JP H10-3200 A 1/1998
JP 2005-258322 A 9/2005
JP 2008-275704 A 11/2008

OTHER PUBLICATIONS

Yamamoto et al., Electrophotographic Color Printer Engine, OKI Technical Review, Aug. 1998, vol. 64, pp. 15-20.*

* cited by examiner

*Primary Examiner* — David M Gray
*Assistant Examiner* — Sevan A Aydin
(74) *Attorney, Agent, or Firm* — Oliff PLC

(57) ABSTRACT

An image forming unit includes an image carrier; a first roller that is in contact with and charges the image carrier; a second roller that is in contact with the first roller and obtains toner from or supplies toner to the first roller; an exposure section that irradiates the charged image carrier with light to form an electrostatic latent image; a development section that develops the electrostatic latent image to form a toner image; a transfer section that transfers the toner image to a transfer member; a control section that performs control such that the toner moves from the image carrier to the first roller and to the second roller or such that the toner to moves from the second roller to the first roller and to the image carrier; and a collecting member that collects the toner that has moved from the first roller to the image carrier.

2 Claims, 7 Drawing Sheets

IMAGE FORMING UNIT AND IMAGE FORMING APPARATUS

CROSS-REFERENCE TO RELATED APPLICATIONS

This application is based on and claims priority under 35 USC 119 from Japanese Patent Application No. 2015-238201 filed Dec. 7, 2015.

BACKGROUND (i) Technical Field

The present invention relates to an image forming unit and an image forming apparatus.

(ii) Related Art

Some image forming apparatuses have charging rollers for charging photoconductors. In such an image forming apparatus having charging rollers, toner on the surfaces of photoconductors may be transported to the positions of the charging rollers without being released, and external additive added to the toner surface may be attached to the charging rollers. If the external additive is attached to the charging rollers, a defective image may be formed.

SUMMARY

According to an aspect of the invention, there is provided an image forming unit including an image carrier; a first roller that is in contact with the image carrier and charges the image carrier; a second roller that is in contact with the first roller and obtains toner from or supplies toner to the first roller; an exposure section that irradiates the charged image carrier with light to form an electrostatic latent image thereon; a development section that develops the electrostatic latent image with the toner to form a toner image; a transfer section that transfers the toner image to a transfer member; a control section that performs control such that the toner moves from the image carrier to the first roller and then moves from the first roller to the second roller or such that the toner moves from the second roller to the first roller and then moves from the first roller to the image carrier; and a collecting member that collects the toner that has moved from the first roller to the image carrier.

BRIEF DESCRIPTION OF THE DRAWINGS

Exemplary embodiments of the present invention will be described in detail based on the following figures, wherein.

DETAILED DESCRIPTION

First Exemplary Embodiment

Figure 1:
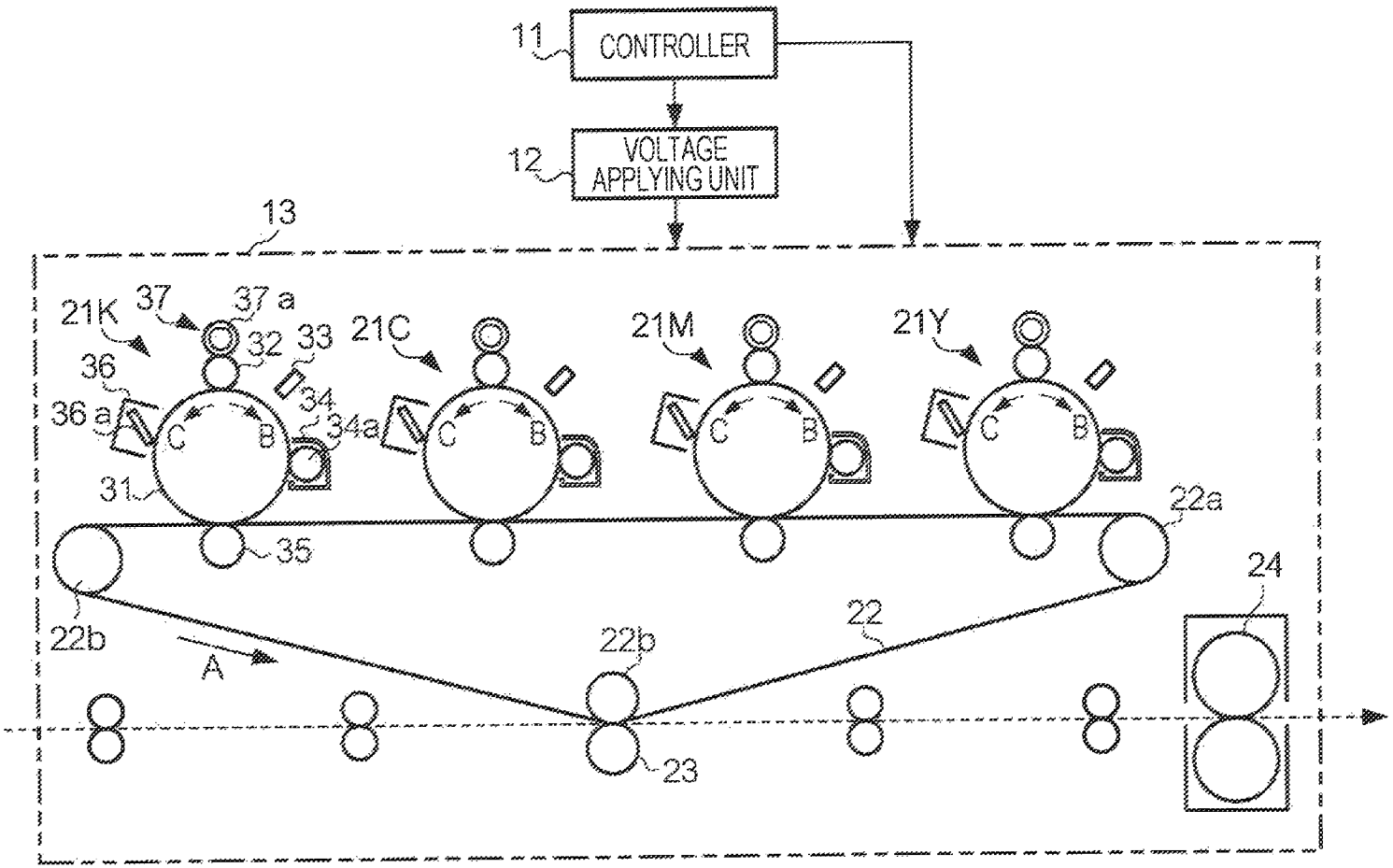
FIG. 1 is a schematic view showing the configuration of an image forming apparatus according to an exemplary embodiment of the present invention.

FIG. 1 is a schematic view showing the configuration of an image forming apparatus according to a first exemplary embodiment of the present invention. A controller 11 serving as an example control section of the present invention includes a central processing unit (CPU), a read-only memory (ROM), and a random-access memory (RAM). The CPU controls a voltage applying unit 12 and an image forming section 13 by executing programs stored in the ROM.

The image forming section 13 forms an image on a sheet serving as an example recording medium by an electrophotographic system and includes image forming units 21Y, 21M, 21C, and 21K, an intermediate transfer belt 22, a second transfer roller 23, and a fixing unit 24. The image forming unit 21Y forms a yellow (Y) toner image, the image forming unit 21M forms a magenta (M) toner image, the image forming unit 21C forms a cyan (C) toner image, and the image forming unit 21K forms a black (K) toner image. The image forming units 21Y, 21M, 21C, and 21K have the same configuration, except for the color of the toner they use. In the description below, when the image forming units do not need to be distinguished from one another, the image forming units will be referred to as the image forming units 21. Although the image forming section 13 according to this exemplary embodiment forms a color image on a sheet, the image forming section 13 may have a single image forming unit, corresponding to black, and may form a monochrome image on a sheet.

Each image forming unit 21 includes a photoconductor drum 31, a charging roller 32, an exposure device 33, a development device 34, a first transfer roller 35, a cleaner 36, and a conducting roller 37. In the following description, when the photoconductor drums 31, charging rollers 32, exposure devices 33, development devices 34, first transfer rollers 35, cleaners 36, and conducting rollers 37 of the image forming units need to be distinguished from one another, the letter suffixed to the reference sign of the corresponding image forming unit will be suffixed to the reference signs of these components.

The photoconductor drum 31 serving as an example image carrier has a photosensitive layer formed on the surface thereof and is rotated about a rotation shaft. The charging roller 32 serving as an example first roller of the present invention has a cylindrical shape and is arranged such that the rotation shaft thereof is parallel to the rotation shaft of the photoconductor drum 31. The surface of the charging roller 32 is in contact with the photoconductor drum 31, and the charging roller 32 charges the surface of the photoconductor drum 31 to a predetermined electric potential. The exposure device 33 serving as an example exposure section of the present invention exposes the surface of the photoconductor drum 31 by irradiating the charged photoconductor drum 31 with light, thus forming an electrostatic latent image on the photoconductor drum 31. The development device 34 serving as an example development section and collecting member of the present invention contains toner. By supplying toner to the photoconductor drum 31 with a development roller 34*a*, the development device 34 develops the electrostatic latent image formed on the photoconductor drum 31, thus forming a toner image. Furthermore, the development device 34 collects the toner on the photoconductor drum 31, as a result of the voltage applied to the development roller 34*a* being controlled. The first transfer roller 35 serving as an example transfer section of the present invention transfers the toner image formed on the photoconductor drum 31 to the intermediate transfer belt 22.

The intermediate transfer belt 22 is supported by a driving roller 22*a* and a backup roller 22*b* and is revolved by the driving roller 22*a* in an arrow A direction in FIG. 1. The intermediate transfer belt 22 transports the toner images transferred from the photoconductor drums 31 of the image forming units 21Y, 21M, 21C, and 21K to the second transfer roller 23. The intermediate transfer belt 22 is an example transfer member to which the toner images are transferred. The second transfer roller 23 transfers the toner image formed on the intermediate transfer belt 22 to a sheet transported to the nip between the backup roller 22*b* and the second transfer roller 23. The sheet to which the toner image has been transferred is transported to the fixing unit 24. The fixing unit 24 fixes the toner image to the sheet by applying heat and pressure. The fixing unit 24 is an example fixing part for fixing an image to a sheet. The sheet to which the toner image has been fixed is discharged from the image forming apparatus 1.

The cleaner 36 includes a plate-shaped blade 36*a* serving as an example collecting member of the present invention. The cleaner 36 removes, with the blade 36*a*, the toner remaining on the photoconductor drum 31 without being transferred to the intermediate transfer belt 22 and collects the toner. The conducting roller 37 serving as an example second roller of the present invention is used to remove external additive attached to the charging roller 32 by holding the toner on a surface layer thereof. The conducting roller 37 includes conducting urethane foam containing carbon black and serving as an elastic layer formed on the surface of a metal cylinder, and a conducting surface layer 37*a* formed on the urethane foam. In this exemplary embodiment, the surface layer 37*a* is formed by wrapping a conductive fabric around the surface of the urethane foam in a spiral manner and bonding the fabric thereto.

The surface layer 37*a* may be a knit, woven, or nonwoven fabric formed of a conductive thread. Alternatively, the conductive fabric may be formed by treating a fabric formed of an insulating thread such that the fabric has conductivity. The surface layer 37*a* does not necessarily have to be formed by wrapping a conductive fabric in a spiral manner, and a conductive fabric woven in a tubular shape may also be used. Although a nylon thread containing carbon black is an example thread for forming the conductive fabric, another thread, such as acrylic, rayon, or polyester thread, containing carbon black may also be used.

The elastic layer does not necessarily have to be formed of urethane foam, but may be formed of a conductive rubber material, such as nitrile rubber, styrene-butadiene rubber, or ethylene-propylene rubber. When the surface layer 37*a* has elasticity, the conducting roller 37 may be configured without an elastic layer.

The voltage applying unit 12 applies voltages to the charging roller 32, the conducting roller 37, the development roller 34*a*, and the first transfer roller 35. The voltage applying unit 12 changes the voltage to apply, in response to the control by the controller 11.

Operation Example in First Exemplary Embodiment

An operation example in the first exemplary embodiment will be described. First, the operation of the image forming units 21 when an image is formed on a sheet will be described. When an image is formed on a sheet, the control by the controller 11 controls such that the photoconductor drums 31 of the image forming units 21 are rotated in an arrow 8 direction in FIG. 1. The surfaces of the photoconductor drums 31 are negatively charged by the charging rollers 32. In this exemplary embodiment, the voltage applying unit 12 applies voltages to the charging rollers 32 and the conducting rollers 37 by a DC-and-AC application method to charge the photoconductor drums 31. In this exemplary embodiment, although the voltage of the DC component in the voltage applied to the charging rollers 32 and the conducting rollers 37 is set to −520 V, and the Vpp and frequency of an alternating-current (AC) component is set to 1.4 kV and 820 Hz, respectively, other settings are also possible.

The exposure devices 33 irradiate the charged surfaces of the photoconductor drums 31 with light, according to the image to be formed on the sheet, and form electrostatic latent images thereon. When negatively charged toner is supplied from the development devices 34 to the photoconductor drums 31, the electrostatic latent images are developed with the toner, and toner images are formed on the surfaces of the photoconductor drums 31. The toner images formed on the surfaces of the photoconductor drums 31 are transferred to the intermediate transfer belt 22 by the first transfer rollers 35. The toner remaining on the photoconductor drums 31 without being transferred to the intermediate transfer belt 22 is removed from the photoconductor drums 31 by the blades 36*a* of the cleaners 36 and is collected.

Portion of the toner that has reached the blades 36*a* passes through the blades 36*a* and reaches the charging rollers 32. Because the charging rollers 32 are in contact with the photoconductor drums 31, the external additive externally added to the toner that has passed through the blades 36*a* is attached to the charging rollers 32. If the image forming operation is continued, and the external additive accumulates on the charging rollers 32, the resistance of the charging rollers 32 changes. If the amount of the external additive attached to the charging rollers 32 increases until the resistance of the charging rollers 32 changes, an abnormal electrical discharge or a decrease in charging potential of the charging rollers 32 occurs. Such a phenomenon makes the electric potential of the photoconductor drums 31 irregular, causing streaks of high-density and low-density portions to be produced in the image to be formed.

Hence, in the present invention, an operation for removing the external additive attached to the charging rollers 32 is performed. This operation may be performed either after images have been formed on a predetermined number of sheets or in response to an instruction from a user.

Figure 2A:
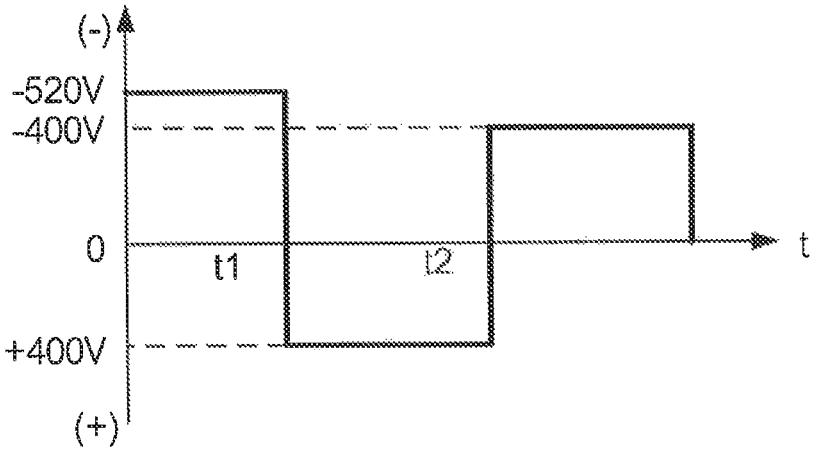
FIGS. 2A and 2B show a direct-current (DC) component in a voltage applied to a charging roller and a conducting roller, respectively.
Figure 2B:
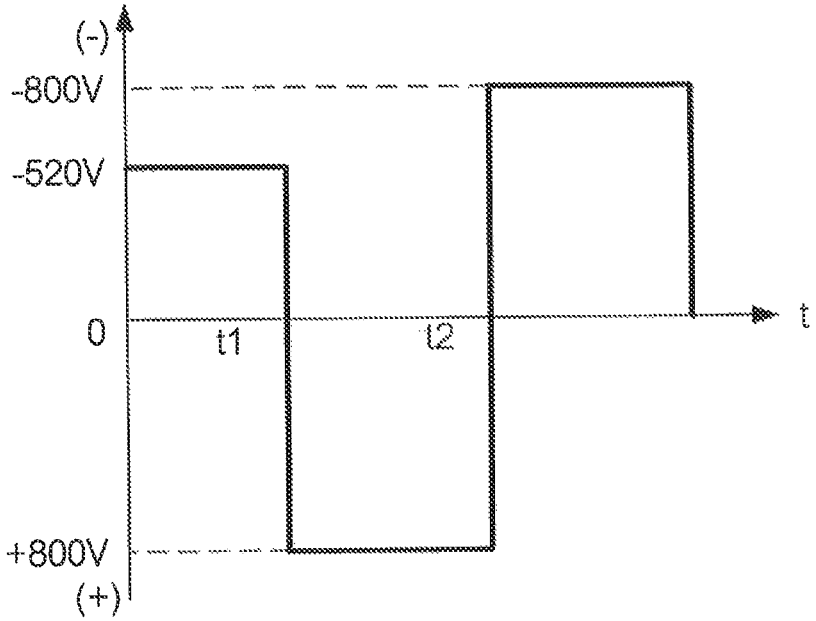

FIG. 2A shows the DC component in the voltage applied to the charging rollers 32 when removing the external additive attached to the charging rollers 32, and FIG. 2B shows the DC component in the voltage applied to the conducting rollers 37 when removing the external additive attached to the charging rollers 32. When removing the external additive attached to the charging rollers 32, the controller 11 controls the positions of the first transfer rollers 35 such that the intermediate transfer belt 22 does not touch the photoconductor drums 31. Then, the controller 11 causes the photoconductor drums 31 to rotate in the arrow B direction and to be charged by the charging rollers 32, as in the case of an image forming operation. Herein, the voltage of the DC component in the voltage to be applied to the charging rollers 32 and the conducting rollers 37 by the voltage applying unit 12 is −520 V. Furthermore, the controller 11 controls the exposure devices 33 and the development devices 34 such that toner images having a predetermined density and area are formed on the photoconductor drums 31. These toner images have a length in the circumferential direction of the photoconductor drums 31 larger than the circumferential length of the charging rollers 32 and have a length in the axial direction of the photoconductor drums 31 larger than the axial length of the charging rollers 32.

When the toner images have been formed (time t1 in FIG. 2), the controller 11 changes the rotation directions of the photoconductor drums 31, the charging rollers 32, and the conducting rollers 37 by controlling the voltages to be applied to the charging rollers 32 and the conducting rollers 37. In this exemplary embodiment, the voltage to be applied to the charging rollers 32 is set to +400 V, and the voltage to be applied to the conducting rollers 37 is set to +800 V. Furthermore, the controller 11 sets the rotation direction of the photoconductor drums 31 to an arrow C direction, sets the rotation direction of the charging rollers 32 to the direction opposite to the rotation direction of the photoconductor drums 31, and sets the rotation direction of the conducting rollers 37 to the same direction as the rotation direction of the charging rollers 32. The rotation direction of the conducting rollers 37 may be opposite to the rotation direction of the charging rollers 32, and the rotation speeds of the conducting rollers 37 and the charging rollers 32 may be differentiated.

After the voltage applied to the charging rollers 32 has reached +400 V and the voltage applied to the conducting rollers 37 has reached +800 V, when the toner images come into contact with the charging rollers 32 as a result of rotation of the photoconductor drums 31, the negatively charged toner moves to the charging rollers 32, which are supplied with a positive voltage. The external additive attached to the outer circumferential surfaces of the charging rollers 32 is attached to the toner moving from the photoconductor drums 31. Because the controller 11, the voltage applying unit 12, and the photoconductor drums 31 supply the toner to the charging rollers 32, the controller 11, the voltage applying unit 12, and the photoconductor drums 31 may be regarded as an example control section for supplying toner to the charging rollers 32.

When the charging rollers 32, to which the toner has moved from the photoconductor drums 31, continue to rotate, portions of the charging rollers 32 to which the toner is attached come into contact with the conducting rollers 37. Because the voltage applied to the charging rollers 32 is +400 V and the voltage applied to the conducting rollers 37 is +800 V, the voltage applied to the conducting rollers 37 is higher than the voltage applied to the charging rollers 32. Thus, the toner attached to the charging rollers 32 moves to the conducting rollers 37 due to the influence of the electric fields formed between the conducting rollers 37 and the charging rollers 32. Because the charging rollers 32 and the conducting rollers 37 are rotated in the same direction, friction is generated between the surface layers 37*a* and the charging rollers 32. This friction causes the external additive attached to the charging rollers 32 to move, allowing more external additive to be attached to the toner.

The controller 11 stops the rotation of the photoconductor drums 31, charging rollers 32, and conducting rollers 37 at a predetermined time (time t2 in FIG. 2). The predetermined time is, for example, a time after the toner at the ends, in the arrow B direction, of the toner images moves to the charging rollers 32 and comes into contact with the surface layers 37*a*. When the rotation of the photoconductor drums 31, charging rollers 32, and conducting rollers 37 is stopped, the controller 11 sets the rotation direction of the photoconductor drums 31 to the arrow B direction, sets the rotation direction of the charging rollers 32 to the direction opposite to the rotation direction of the photoconductor drums 31, sets the rotation direction of the conducting rollers 37 to the direction opposite to the rotation direction of the charging rollers 32, and rotates the photoconductor drums 31, the charging rollers 32, and the conducting rollers 37. Furthermore, the controller 11, by controlling the voltage applying unit 12, controls the voltage to be applied to the development rollers 34*a* such that the toner on the surfaces of the photoconductor drums 31 is collected by the development rollers 34*a* of the development devices 34 and controls the positions of the first transfer rollers 35 such that the intermediate transfer belt 22 touches the photoconductor drums 31.

Furthermore, the controller 11, by controlling the voltage applying unit 12, controls the voltages to be applied to the charging rollers 32 and the conducting rollers 37 such that the voltage to be applied to the charging rollers 32 is −400 V and the voltage to be applied to the conducting rollers 37 is −800 V. Herein, because the voltage applied to the charging rollers 32 is higher than the voltage applied to the conducting rollers 37, the toner attached to the surface layers 37*a* moves to the charging rollers 32 due to the influence of the electric fields formed between the conducting rollers 37 and the charging rollers 32. The toner that has moved from the conducting rollers 37 to the charging rollers 32 moves to the photoconductor drums 31.

Because the controller 11 and the voltage applying unit 12 cause the toner to move from the conducting rollers 37 to the charging rollers 32, and then from the charging rollers 32 to the photoconductor drums 31, the controller 11 and the voltage applying unit 12 may be regarded as an example toner-moving section that controls the movement of the toner.

When the photoconductor drums 31 are rotated, the toner that has moved from the charging rollers 32 to the photoconductor drums 31 is collected by the development rollers 34*a* of the development devices 34. The toner remaining on the photoconductor drums 31 without being collected by the development devices 34 is transferred to the intermediate transfer belt 22 by the first transfer rollers 35. The toner transferred to the intermediate transfer belt 22 is peeled off from the intermediate transfer belt 22 by a cleaner (not shown) and is collected. The toner remaining on the photoconductor drums 31 without being transferred to the intermediate transfer belt 22 is removed by the blades 36*a* that are in contact with the photoconductor drums 31 and is collected by the cleaners 36.

In the first exemplary embodiment, the external additive attached to the charging rollers 32 is attached to the toner moving from the photoconductor drums 31. The toner, to which the external additive is attached, moves away from the charging rollers 32, whereby the external additive is removed from the charging rollers 32.

Second Exemplary Embodiment

An image forming apparatus according to a second exemplary embodiment of the present invention will be described. Similarly to the image forming apparatus according to the first exemplary embodiment, the image forming apparatus according to the second exemplary embodiment of the present invention includes the controller 11, the voltage applying unit 12, and the image forming section 13. The second exemplary embodiment differs from the first exemplary embodiment in the operation for removing the external additive attached to the charging rollers 32. An example operation for removing the external additive attached to the charging rollers 32 will be described below.

In the second exemplary embodiment, when removing the external additive attached to the charging rollers 32, the controller 11 first controls the positions of the first transfer rollers 35 such that the intermediate transfer belt 22 does not touch the photoconductor drums 31. The controller 11 also controls the cleaners 36 such that the blades 36*a* are separated from the photoconductor drums 31.

Then, as in the first exemplary embodiment, the image forming section 13 forms toner images having a predetermined density and area on the surfaces of the photoconductor drums 31. When the toner images have been formed on the photoconductor drums 31, the controller 11 maintains the rotation direction (i.e., the arrow B direction) of the photoconductor drums 31. Because the intermediate transfer belt 22 is separated from the photoconductor drums 31, and the blades 36*a* are separated from the photoconductor drums 31, when the photoconductor drums 31 continue to rotate in the arrow B direction, the toner images move toward the charging rollers 32 without coming into contact with the intermediate transfer belt or the blades 36*a*. The controller 11, by controlling the voltage applying unit 12, controls the voltages to be applied to the charging rollers 32 and the conducting rollers 37 before the toner images reach the charging rollers 32. In this exemplary embodiment, the voltage to be applied to the charging rollers 32 is set to +400 V, and the voltage to be applied to the conducting rollers 37 is set to +800 V. Furthermore, the controller 11 causes the conducting rollers 37 to rotate in the direction in which the charging rollers 32 are rotated. The rotation direction of the conducting rollers 37 may be opposite to the rotation direction of the charging rollers 32, and the rotation speeds of the conducting rollers 37 and the charging rollers 32 may be differentiated.

After the voltage applied to the charging rollers 32 has reached +400 V and the voltage applied to the conducting rollers 37 has reached +800 V, when the toner images come into contact with the charging rollers 32 as a result of rotation of the photoconductor drums 31, the negatively charged toner moves to the charging rollers 32, which are supplied with a positive voltage. The external additive attached to the outer circumferential surfaces of the charging rollers 32 is attached to the toner moving from the photoconductor drums 31.

When the charging rollers 32 continue to rotate, portions of the charging rollers 32 to which the toner is attached come into contact with the conducting rollers 37. Because the voltage applied to the charging rollers 32 is +400 V and the voltage applied to the conducting rollers 37 is +800 V, the voltage applied to the conducting rollers 37 is higher than the voltage applied to the charging rollers 32. Thus, the toner attached to the charging rollers 32 moves to the conducting rollers 37 due to the influence of the electric fields formed between the conducting rollers 37 and the charging rollers 32. Because the charging rollers 32 and the conducting rollers 37 are rotated in the same direction, friction is generated between the surface layers 37*a* and the charging rollers 32. This friction causes the external additive attached to the charging rollers 32 to move, allowing more external additive to be attached to the toner.

After the toner has moved to the conducting rollers 37, at a predetermined time, the controller 11, by controlling the voltage applying unit 12, controls the voltages to be applied to the charging rollers 32 and the conducting rollers 37 and sets the voltage to be applied to the charging rollers 32 to −400 V and the voltage to be applied to the conducting rollers 37 to −800 V. The predetermined time is, for example, a time after the toner at the ends, in the arrow C direction, of the toner images moves to the charging rollers 32 and comes into contact with the surface layers 37*a*.

Furthermore, the controller 11, by controlling the voltage applying unit 12, controls the voltage to be applied to the development rollers 34*a* such that the toner on the surfaces of the photoconductor drums 31 is collected by the development rollers 34*a* of the development devices 34. Moreover, the controller 11 controls the positions of the first transfer rollers 35 such that the intermediate transfer belt 22 touches the photoconductor drums 31 and controls the positions of the blades 36*a* such that the blades 36*a* are in contact with the photoconductor drums 31. The operation after the voltages to be applied to the conducting rollers 37 and the charging rollers 32 are changed is the same as that according to the first exemplary embodiment, and thus, a description thereof will be omitted.

Also in the second exemplary embodiment, the external additive attached to the charging rollers 32 is attached to the toner moving from the photoconductor drums 31. The toner, to which the external additive is attached, moves away from the charging rollers 32, whereby the external additive is removed from the charging rollers 32.

Third Exemplary Embodiment

Figure 3:
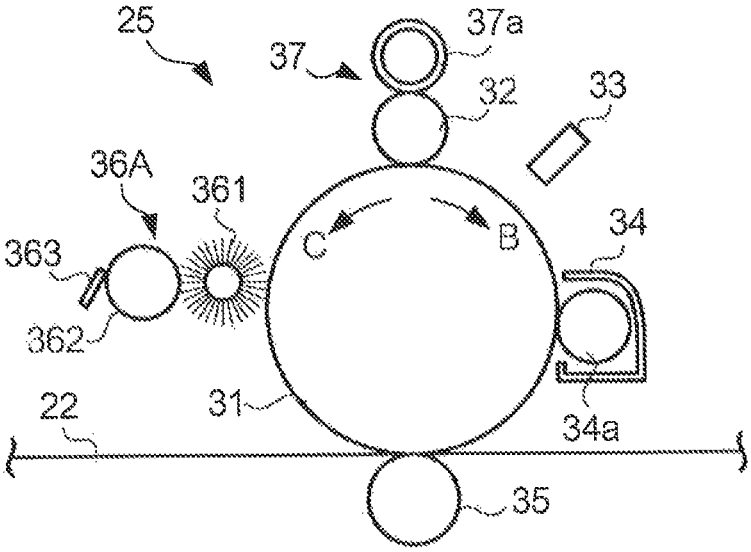
FIG. 3 is a schematic view showing the configuration of an image forming unit according to a third exemplary embodiment.

A third exemplary embodiment of the present invention will be described. FIG. 3 is a schematic view showing the configuration of an image forming unit 25 according to the third exemplary embodiment of the present invention. The image forming section 13 according to the third exemplary embodiment includes the image forming units 25, instead of the image forming units 21. The image forming units 25 are different from the image forming units 21 in the configuration for removing and collecting the toner remaining on the photoconductor drums 31 without being transferred to the intermediate transfer belt 22. The image forming units 25 include cleaners 36A, instead of the cleaners 36.

The cleaners 36A each include a brush roller 361, a collecting roller 362, and a blade 363. The brush roller 361 serves as an example third roller of the present invention. The brush roller 361 is disposed such that the rotation shaft thereof is parallel to the rotation shaft of the photoconductor drum 31 and such that a brush layer thereof is in contact with the surface of the photoconductor drum 31. The collecting roller 362 is disposed such that the rotation shaft thereof is parallel to the rotation shaft of the brush roller 361 and such that the surface thereof is in contact with the brush layer of the brush roller 361. The blade 363 is disposed such that it is parallel to the rotation shaft of the collecting roller 362 and such that it is in contact with the surface of the collecting roller 362.

An operation example in the third exemplary embodiment will be described. First, an operation to be performed when an image is formed on a sheet will be described. Because the operation including charging of photoconductor drums 31, formation of electrostatic latent images, development of the electrostatic latent images, and transfer of toner images to the intermediate transfer belt 22 is the same as that according to the first exemplary embodiment, the description thereof will be omitted.

The toner remaining on the photoconductor drums 31 without being transferred to the intermediate transfer belt 22 is transported to the positions of the brush rollers 361. The cleaners 36A are controlled by the controller 11, and, in an image forming operation, the brush rollers 361 and the collecting rollers 362 are rotated in the direction in which the photoconductor drums 31 are rotated. Furthermore, the controller 11 controls the voltage applying unit 12 such that a voltage of +400 V is applied to the brush rollers 361 and a voltage of +800 V is applied to the collecting roller 362 in the image forming operation.

The negatively charged toner remaining on the photoconductor drums 31 moves to the brush rollers 361, which are supplied with a positive voltage. When portions of the brush rollers 361 to which the toner is attached come into contact with the collecting rollers 362, because the voltage applied to the collecting rollers 362 is higher than the voltage applied to the brush rollers 361, the toner attached to the brush rollers 361 moves to the collecting rollers 362 due to the influence of the electric fields formed between the brush rollers 361 and the collecting rollers 362. The toner that has moved to the collecting rollers 362 is removed by the blades 363 and is collected.

Portion of the toner remaining on the photoconductor drums 31 without being transferred to the intermediate transfer belt 22 passes through the brush rollers 361 and reaches the charging rollers 32. Because the charging rollers 32 are in contact with the photoconductor drums 31, the external additive externally added to the toner that has passed through the brush rollers 361 is attached to the charging rollers 32. If the amount of the external additive attached to the charging rollers 32 continues to increase, as in the case of the first exemplary embodiment, high-toner-density and low-toner-density streaks will appear in the image to be formed.

Hence, also in the third exemplary embodiment, an operation for removing the external additive attached to the charging rollers 32 is performed. This operation may be performed either at a time when images have been formed on a predetermined number of sheets or in response to an instruction from a user.

Figure 4A:
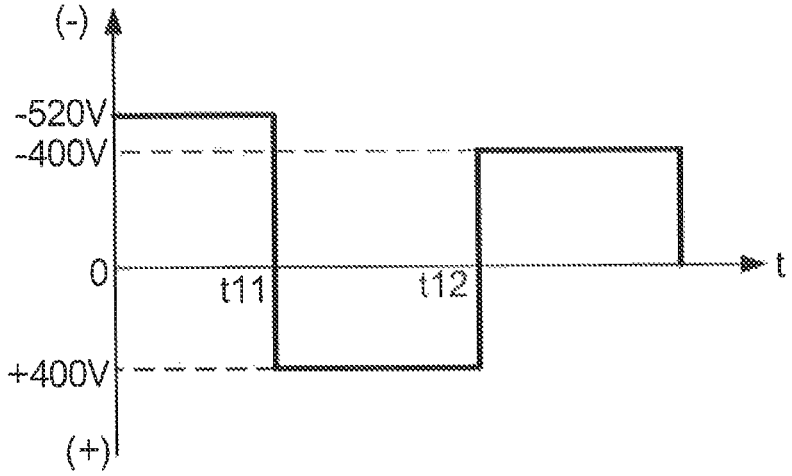
FIGS. 4A, 4B, and 4C show the DC component in the voltage applied to the charging roller, the conducting roller, and a brush roller, respectively.
Figure 4B:
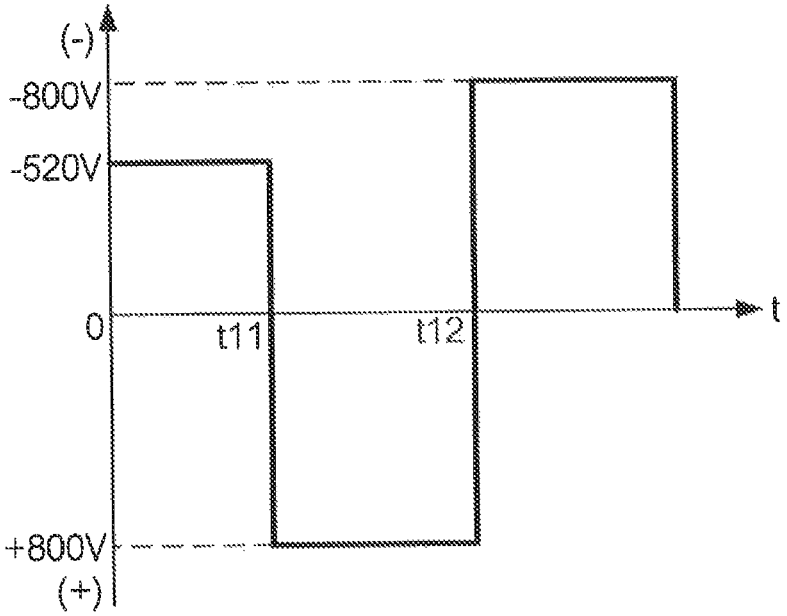
Figure 4C:
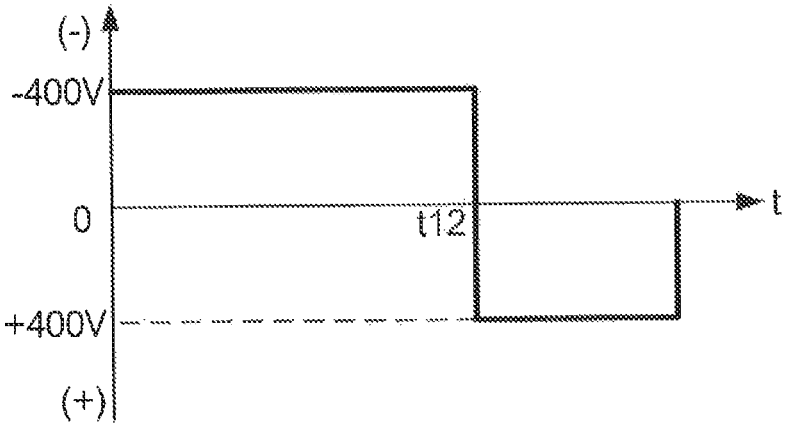

FIG. 4A shows the DC component in the voltage applied to the charging rollers 32 when removing the external additive attached to the charging rollers 32, FIG. 4*b* shows the DC component in the voltage applied to the conducting rollers 37 when removing the external additive attached to the charging rollers 32, and FIG. 4C shows the DC component in the voltage applied to the brush rollers 361 when removing the external additive attached to the charging rollers 32, according to the third exemplary embodiment. In the third exemplary embodiment, when removing the external additive attached to the charging rollers 32, the controller 11 controls the positions of the first transfer rollers 35 such that the intermediate transfer belt 22 does not touch the photoconductor drums 31. Furthermore, the controller 11 controls the cleaners 36A such that the voltage applied to the brush rollers 361 and the collecting rollers 362 is −400 V.

Then, the controller 11 causes the photoconductor drums 31 to rotate in the arrow B direction and to be charged by the charging rollers 32, as in the case of an image forming operation. Furthermore, the controller 11 controls the exposure devices 33 and the development devices 34 such that toner images having a predetermined density and area are formed on the photoconductor drums 31.

When the photoconductor drums 31 continue to rotate in the arrow B direction, as described above, because the positions of the first transfer rollers 35 are controlled such that the intermediate transfer belt 22 does not touch the photoconductor drums 31, the toner images formed on the photoconductor drums 31 reach the positions of the brush rollers 361 without being transferred to the intermediate transfer belt 22. Because the voltage applied to the brush rollers 361 is −400 V, the negatively charged toner images pass through the brush rollers 361 and move toward the charging rollers 32.

The controller 11, by controlling the voltage applying unit 12, controls the voltages to be applied to the charging rollers 32 and the conducting rollers 37 (time t11 in FIG. 4) before the toner images that have left the charging rollers 32 and passed through the brush rollers 361 reach the charging rollers 32 again. In this exemplary embodiment, the voltage to be applied to the charging rollers 32 is set to +400 V, and the voltage to be applied to the conducting rollers 37 is set to +800 V. Furthermore, the controller 11 causes the conducting rollers 37 to rotate in the direction in which the charging rollers 32 are rotated. The rotation direction of the conducting rollers 37 may be opposite to the rotation direction of the charging rollers 32, and the rotation speeds of the conducting rollers 37 and the charging rollers 32 may be differentiated.

After the voltage applied to the charging rollers 32 has reached +400 V and the voltage applied to the conducting rollers 37 has reached +800 V, when the toner images come into contact with the charging rollers 32 as a result of rotation of the photoconductor drums 31, the toner particles in the toner images move to the charging rollers 32, which are supplied with a positive voltage. The external additive attached to the outer circumferential surfaces of the charging rollers 32 is attached to the toner moving from the photoconductor drums 31.

The subsequent operation up to when the toner attached to the charging rollers 32 moves to the conducting rollers 37 is the same as that according to the first exemplary embodiment. At a predetermined time, the controller 11 controls the positions of the first transfer rollers 35 such that the intermediate transfer belt 22 touches the photoconductor drums 31.

Furthermore, the controller 11 controls the voltage to be applied to the charging rollers 32, the voltage to be applied to the conducting rollers 37, the voltage to be applied to the brush rollers 361, and the voltage to be applied to the collecting rollers 362. More specifically, the controller 11, by controlling the voltage applying unit 12, sets the voltage to be applied to the charging rollers 32 to −400 V, the voltage to be applied to the conducting rollers 37 to −800 V, the voltage to be applied to the brush rollers 361 to +400 V, and the voltage to be applied to the collecting rollers 362 to +800 V (time t12 in FIG. 4). The controller 11 also controls the voltage to be applied to the development rollers such that the toner on the surfaces of the photoconductor drums 31 is collected by the development rollers of the development devices 34.

Because the voltage applied to the charging rollers 32 is higher than the voltage applied to the conducting rollers 37, the toner attached to the surface layers 37*a* moves to the charging rollers 32 due to the influence of the electric fields formed between the conducting rollers 37 and the charging rollers 32. The toner that has moved from the conducting rollers 37 to the charging rollers 32 moves to the photoconductor drums 31.

When the photoconductor drums 31 are rotated, the toner that has moved from the charging rollers 32 to the photoconductor drums 31 is collected by the development rollers 34*a* of the development devices 34. The toner remaining on the photoconductor drums 31 without being collected by the development devices 34 is transferred to the intermediate transfer belt 22 by the first transfer rollers 35. The toner transferred to the intermediate transfer belt 22 is peeled off from the intermediate transfer belt 22 by the cleaner (not shown) and is collected. The toner remaining on the photoconductor drums 31 without being transferred to the intermediate transfer belt 22 is collected by the cleaners 36A, as in the case of an image forming operation.

Also in the third exemplary embodiment, the external additive attached to the charging rollers 32 is attached to the toner moving from the photoconductor drums 31. The toner, to which the external additive is attached, moves away from the charging rollers 32, whereby the external additive is removed from the charging rollers 32.

Fourth Exemplary Embodiment

Figure 5:
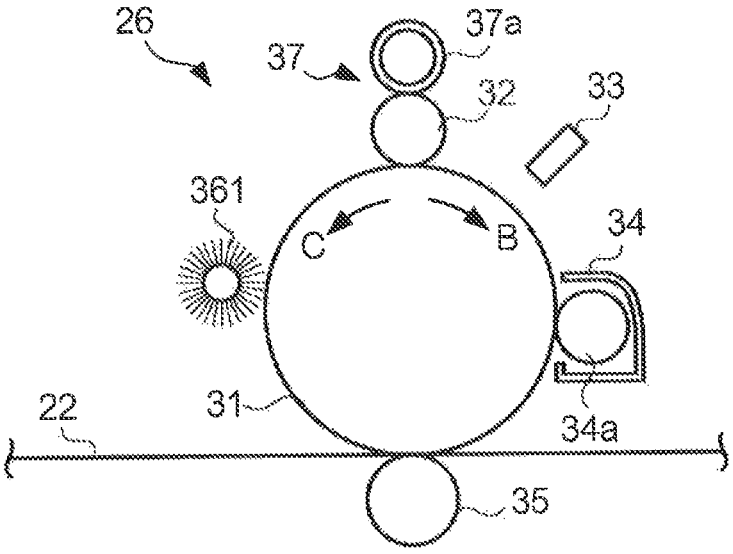
FIG. 5 is a schematic view showing the configuration of an image forming unit according to a fourth exemplary embodiment.

A fourth exemplary embodiment of the present invention will be described. FIG. 5 is a schematic view showing the configuration of an image forming unit 26 according to the fourth exemplary embodiment of the present invention. The image forming section 13 according to the fourth exemplary embodiment includes image forming units 26, instead of the image forming units 25 according to the third exemplary embodiment. The image forming units 26 differ from the image forming units 25 in that the image forming units 26 do not have the collecting rollers 362 and the blades 363.

An operation example in the fourth exemplary embodiment will be described. First, an operation to be performed when an image is formed on a sheet will be described. When an image is to be formed on a sheet in the fourth exemplary embodiment, the controller 11 controls such that the photoconductor drums 31 of the image forming unit 26 are rotated in the arrow B direction in FIG. 5. The electric potential of the surfaces of the photoconductor drums 31 is made negative by the charging rollers 32. In this exemplary embodiment, the photoconductor drums 31 are charged by applying voltages to the charging rollers 32 and the conducting rollers 37 by a DC application method. Although the voltage of the DC component in the voltage applied to the charging rollers 32 and the conducting rollers 37 is set to −1100 V in this exemplary embodiment, other settings are also possible.

The exposure devices 33 form electrostatic latent images by irradiating the surfaces of the photoconductor drums 31 having a negative electric potential with light according to the image to be formed. When the toner is supplied from the development devices 34 to the photoconductor drums 31, the electrostatic latent images are developed with the toner, and toner images are formed on the surfaces of the photoconductor drums 31. The toner images formed on the surfaces of the photoconductor drums 31 are transferred to the intermediate transfer belt 22 by the first transfer rollers 35. The toner remaining on the photoconductor drums 31 without being transferred to the intermediate transfer belt 22 is transported to the positions of the brush rollers 361.

The controller 11 controls the voltage applying unit 12 and applies a voltage to the brush rollers 361 by the DC-and-AC application method in the image forming operation. In this exemplary embodiment, although the voltage of the DC component in the voltage applied is set to 0 V, and the Vpp and frequency of the AC component are set to 600 V and 3 kHz, respectively, other settings are also possible.

The toner remaining on the photoconductor drums 31 includes positively charged toner and negatively charged toner. By applying an AC voltage to the brush rollers 361 with the DC component being set to 0 V, the positively charged toner or the negatively charged toner move to the brush rollers 361, depending on the polarity of the voltage applied to the brush rollers 361.

Portion of the toner on the photoconductor drums 31 that has reached the positions of the brush rollers 361 passes through the brush rollers 361 and reaches the charging rollers 32. Because the charging rollers 32 are in contact with the photoconductor drums 31, the external additive externally added to the toner that has passed through the brush rollers 361 is attached to the charging rollers 32. If the amount of the external additive attached to the charging rollers 32 continues to increase, as described in the first exemplary embodiment, high-toner-density and low-toner-density streaks will appear in the image to be formed. Hence, also in the fourth exemplary embodiment, an operation for removing the external additive attached to the charging rollers 32 is performed.

Figure 6A:
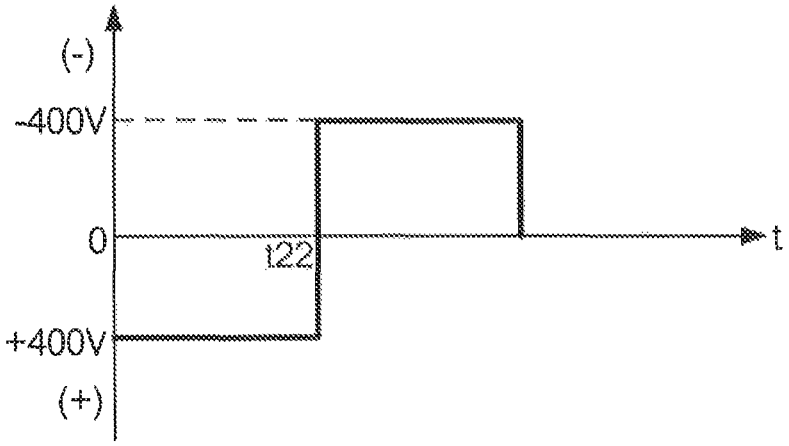
FIGS. 6A, 6B, and 6C show the DC component in the voltage applied to the charging roller, the conducting roller, and the brush roller, respectively.
Figure 6B:
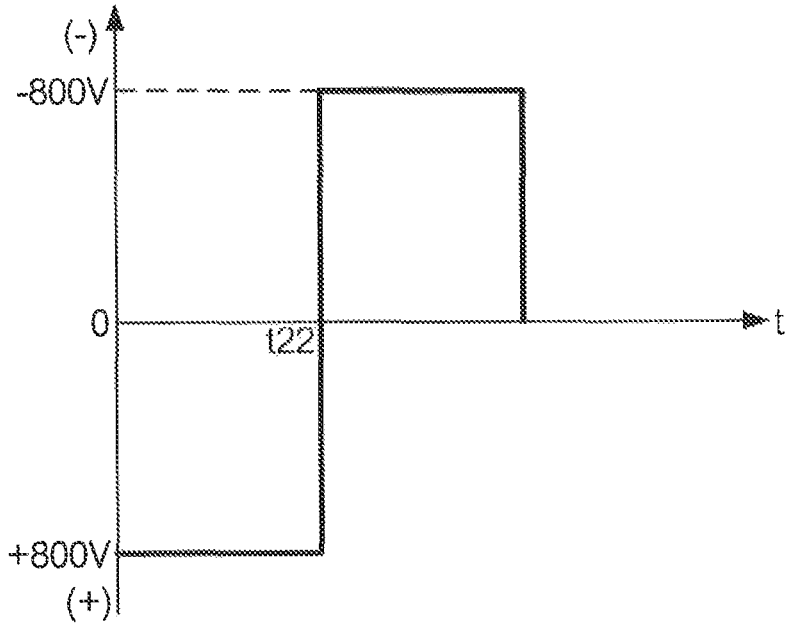
Figure 6C:
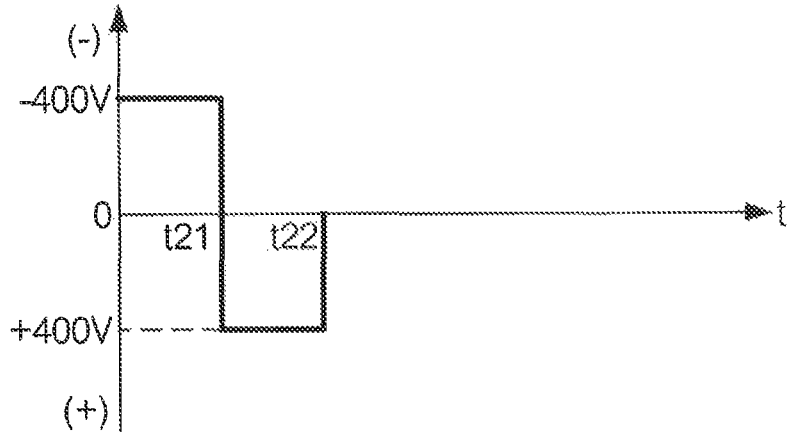

FIG. 6A shows the DC component in the voltage applied to the charging rollers 32 when removing the external additive attached to the charging rollers 32, FIG. 68 shows the DC component in the voltage applied to the conducting rollers 37 when removing the external additive attached to the charging rollers 32, and FIG. 6C shows the DC component in the voltage applied to the brush rollers 361 when removing the external additive attached to the charging rollers 32, according to the fourth exemplary embodiment. In the fourth exemplary embodiment, when removing the external additive attached to the charging rollers 32, the controller 11, by controlling the voltage applying unit 12, sets the voltage to be applied to the charging rollers 32 to +400 V and the voltage to be applied to the conducting rollers 37 to +800 V.

Furthermore, the controller 11 causes the brush rollers 361 to rotate and controls the voltage to be applied to the brush rollers 361. In this exemplary embodiment, the controller 11, by controlling the voltage applying unit 12, sets the voltage to be applied to the brush rollers 361 first to −400 V, as shown in FIG. 6C. By setting the voltage to be applied to the brush rollers 361 to −400 V, the negatively charged toner attached to the brush rollers 361 moves from the brush rollers 361 to the photoconductor drums 31. The negatively charged toner that has moved to the photoconductor drums 31 is transported to the positions of the charging rollers 32 as the photoconductor drums 31 rotate.

When the negatively charged toner on the photoconductor drums 31 comes into contact with the charging rollers 32, the voltage being applied to the charging rollers 32 is +400 V, and the voltage being applied to the conducting rollers 37 is +800 V. Thus, when the negatively charged toner comes into contact with the charging rollers 32, the negatively charged toner moves to the charging rollers 32, which are supplied with a positive voltage. The external additive attached to the outer circumferential surfaces of the charging rollers 32 is attached to the toner moving from the photoconductor drums 31. The operation up to when the toner transferred to the charging rollers 32 moves to the conducting rollers 37 is the same as that according to the first exemplary embodiment.

When a predetermined period of time has elapsed since a voltage of −400 V is applied to the brush rollers 361 (time t21 in FIG. 6C), the controller 11 controls the voltage applying unit 12 such that the voltage to be applied to the brush rollers 361 is +400 V. By setting the voltage to be applied to the brush rollers 361 to +400 V, the positively charged toner attached to the brush rollers 361 moves from the brush rollers 361 to the photoconductor drums 31.

When a predetermined period of time has elapsed since a voltage of +400 V is applied to the brush rollers 361 (time t22 in FIG. 6), the controller 11, by controlling the voltage applying unit 12, applies an AC voltage to the brush rollers 361 with the DC component being set to 0 V and sets the voltage to be applied to the charging rollers 32 to −400 V and the voltage to be applied to the conducting rollers 37 to −800 V.

Because the voltage applied to the charging rollers 32 is higher than the voltage applied to the conducting rollers 37, the toner attached to the surface layers 37*a* moves to the charging rollers 32. Furthermore, the toner that has moved from the conducting rollers 37 to the charging rollers 32 moves to the photoconductor drums 31.

When the photoconductor drums 31 are rotated, the toner that has moved from the charging rollers 32 to the photoconductor drums 31 is collected by the development rollers 34*a* of the development devices 34. The toner remaining on the photoconductor drums 31 without being collected by the development devices 34 is transferred to the intermediate transfer belt 22 by the first transfer rollers 35. The toner transferred to the intermediate transfer belt 22 is peeled off from the intermediate transfer belt 22 by the cleaner (not shown) and is collected. The toner remaining on the photoconductor drums 31 without being transferred to the intermediate transfer belt 22 moves to the brush rollers 361, as in the case of an image forming operation.

Also in the fourth exemplary embodiment, the external additive attached to the charging rollers 32 is attached to the toner moving from the photoconductor drums 31. The toner, to which the external additive is attached, moves away from the charging rollers 32, whereby the external additive is removed from the charging rollers 32.

Fifth Exemplary Embodiment

A fifth exemplary embodiment of the present invention will be described. The image forming section 13 according to the fifth exemplary embodiment includes the image forming units 26, which are the same as those according to the fourth exemplary embodiment. In this exemplary embodiment, the voltages to be applied to the charging rollers 32, the conducting rollers 37, and the brush rollers 361 are different from those in the fourth exemplary embodiment.

An operation example in the fifth exemplary embodiment will be described. First, an operation to be performed when an image is formed on a sheet will be described. Because the operation including charging of photoconductor drums 31, formation of electrostatic latent images, development of the electrostatic latent images, and transfer of toner images to the intermediate transfer belt 22 is the same as that according to the first exemplary embodiment, the description thereof will be omitted.

When an image is to be formed on a sheet, the controller 11 sets the voltage to be applied to the brush rollers 361 to −1 kV and causes the brush rollers 361 to rotate. The toner remaining on the photoconductor drums 31 without being transferred to the intermediate transfer belt 22 is transported to the positions of the brush rollers 361. Although the toner on the photoconductor drums 31 includes positively charged toner and negatively charged toner, the positively charged toner is negatively charged by discharge of the brush rollers 361. As a result, all the toner attached to the photoconductor drums 31 is negatively charged. Because a minus voltage is applied to the brush rollers 361, portion of the positively charged toner moves to the brush rollers 361. The voltage to be applied to the brush rollers 361 is not limited to −1 kV, but may be any voltage as long as it negatively charges all the toner remaining on the photoconductor drums 31.

Portion of the toner remaining on the photoconductor drums 31 without being transferred to the intermediate transfer belt 22 passes through the brush rollers 361 and reaches the charging rollers 32. Because the charging rollers 32 are in contact with the photoconductor drums 31, the external additive externally added to the toner that has passed through the brush rollers 361 is attached to the charging rollers 32.

Figure 7A:
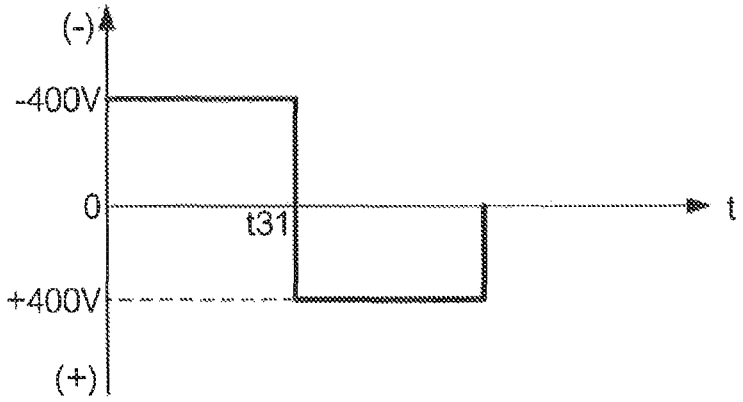
FIGS. 7A, 7B, and 7C show the DC component in the voltage applied to the charging roller, the conducting roller, and the brush roller, respectively.
Figure 7B:
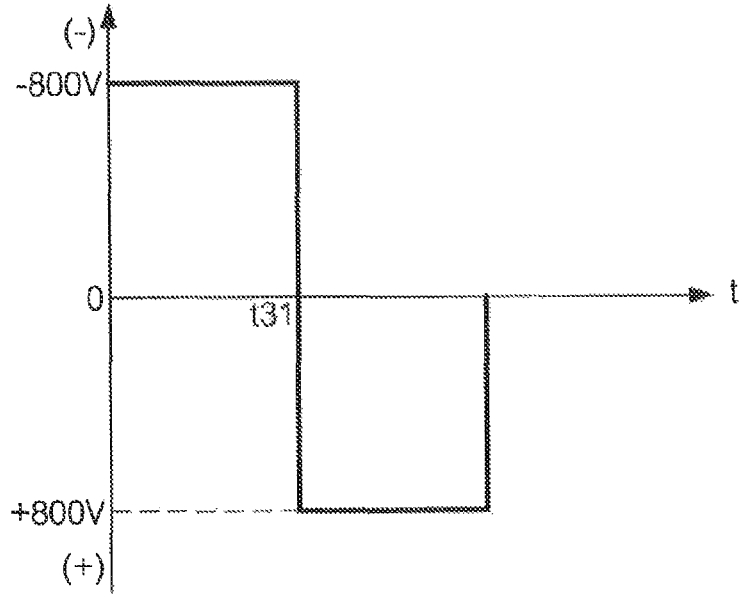
Figure 7C:
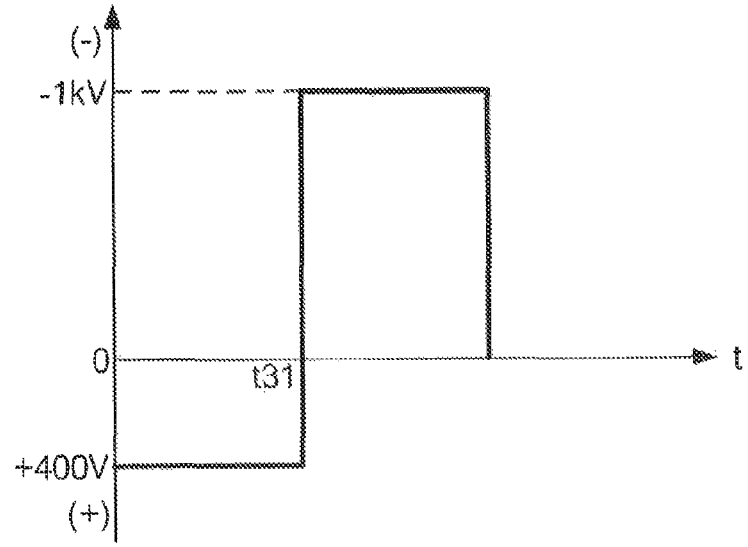

An example operation for removing the external additive attached to the charging rollers 32 will be described below. FIG. 7A shows the DC component in the voltage applied to the charging rollers 32 when removing the external additive attached to the charging rollers 32, FIG. 7B shows the DC component in the voltage applied to the conducting rollers 37 when removing the external additive attached to the charging rollers 32, and FIG. 7C shows the DC component in the voltage applied to the brush rollers 361 when removing the external additive attached to the charging rollers 32.

In the fifth exemplary embodiment, when removing the external additive attached to the charging rollers 32, the controller 11 controls the voltages to be applied to the charging rollers 32 and the conducting rollers 37. More specifically, the controller 11, by controlling the voltage applying unit 12, sets the voltage to be applied to the charging rollers 32 to −400 V and the voltage to be applied to the conducting rollers 37 to −800 V, as shown in FIGS. 7A to 7C. Furthermore, the controller 11 sets the voltage to be applied to the brush rollers 361 to +400 V.

By setting the voltage to be applied to the brush rollers 361 to +400 V, the positively charged toner attached to the brush rollers 361 moves from the brush rollers 361 to the photoconductor drums 31. The positively charged toner that has moved to the photoconductor drums 31 is transported to the positions of the charging rollers 32 as the photoconductor drums 31 rotate. The voltage applied to the charging rollers 32 is −400 V, and the voltage applied to the conducting rollers 37 is −800 V. In this state, if the positively charged toner comes into contact with the charging rollers 32, the positively charged toner moves to the charging rollers 32, which are supplied with a minus voltage. The external additive attached to the outer circumferential surfaces of the charging rollers 32 is attached to the toner moving from the photoconductor drums 31.

When the charging rollers 32 continue to rotate, portions of the charging rollers 32 to which the toner is attached come into contact with the conducting rollers 37. Because the voltage applied to the charging rollers 32 is −400 V and the voltage applied to the conducting rollers 37 is −800 V, the voltage applied to the conducting rollers 37 is lower than the voltage applied to the charging rollers 32. Thus, the toner attached to the charging rollers 32 moves to the conducting rollers 37.

At a predetermined time (time t31 in FIG. 7) after setting the voltage to be applied to the charging rollers 32 to −400 V and the voltage to be applied to the conducting rollers 37 to −800 V, the controller 11, by controlling the voltage applying unit 12, sets the voltage to be applied to the charging rollers 32 to +400 V and the voltage to be applied to the conducting rollers 37 to +800 V. Furthermore, the controller 11 sets the voltage to be applied to the brush rollers 361 to −1 kV. Because the positive voltage to be applied to the charging rollers 32 is lower than the positive voltage to be applied to the conducting rollers 37, the toner attached to the surface layers 37*a* moves to the charging rollers 32. The toner that has moved from the conducting rollers 37 to the charging rollers 32 moves to the photoconductor drums 31. The toner that has moved to the photoconductor drums 31 is collected by the development devices 34. The toner remaining on the photoconductor drums 31 without being collected by the development devices 34 is transferred to the intermediate transfer belt 22 by the first transfer rollers 35. The toner transferred to the intermediate transfer belt 22 is peeled off from the intermediate transfer belt 22 by the cleaner (not shown) and is collected.

Also in the fifth exemplary embodiment, the external additive attached to the charging rollers 32 is attached to the toner moving from the photoconductor drums 31. The toner, to which the external additive is attached, moves away from the charging rollers 32, whereby the external additive is removed from the charging rollers 32.

Modification

Although exemplary embodiments of the present invention have been described above, the present invention is not limited to the above-described exemplary embodiments, but may be embodied in various forms. For example, the present invention may be embodied by modifying the above-described exemplary embodiments into the following forms. Note that the above-described exemplary embodiments and the following modifications may be combined.

In the present invention, in an image forming operation, equal voltages may be applied to the conducting rollers 37 and the charging rollers 32. Furthermore, the conducting rollers 37 may be in an electrically open state (i.e., the conducting rollers 37 are not grounded or supplied with a voltage).

In the above-described exemplary embodiments, although the conducting rollers 37 have a conductive fabric constituting the surface layers 37*a*, the configuration of the conducting rollers 37 is not limited thereto. The conducting rollers 37 may be conductive brush rollers or conductive sponge rollers.

In the above-described exemplary embodiments, although the external additive on the charging rollers 32 is removed by moving the toner on the photoconductor drums 31 to the charging rollers 32, the configuration for supplying toner to the charging rollers 32 is not limited to the configuration described in the exemplary embodiments. For example, the toner collected by the cleaners 36 and the cleaners 36A may be transported to the charging rollers 32, thereby supplying the toner to the charging rollers 32.

In the above-described exemplary embodiments, although the toner attached to the charging rollers 32 is moved to the conducting rollers 37 by controlling the voltages to be applied to the charging rollers 32 and the conducting rollers 37, if the toner moves from the charging rollers 32 to the conducting rollers 37 by causing the charging rollers 32 and the conducting rollers 37 to rotate in the same direction, there is no need to apply voltages to the charging rollers 32 and the conducting rollers 37 when moving the toner from the charging rollers 32 to the conducting rollers 37.

In the above-described exemplary embodiments, transfer of the toner to the intermediate transfer belt 22 is prevented by controlling the positions of the first transfer rollers 35, alternatively, the voltage to be applied to the first transfer rollers 35 may be controlled such that the toner is not transferred to the intermediate transfer belt 22, with the first transfer rollers 35 urging the intermediate transfer belt 22 against the photoconductor drums 31.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming unit comprising:

an image carrier;

a first roller that is in contact with the image carrier and charges the image carrier;

a second roller that is in contact with the first roller and obtains toner from or supplies toner to the first roller;

an exposure section that irradiates the charged image carrier with light to form an electrostatic latent image thereon;

a development section that develops the electrostatic latent image with the toner to form a toner image;

a transfer section that transfers the toner image to a transfer member;

a control section that controls the image forming unit, in an external additive removal operation, to form a toner image on the image carrier, to subsequently reverse a rotation direction of the image carrier such that the image carrier rotates in a direction opposite a first direction of rotation and transfer toner from the toner image from the image carrier to the first roller and then from the first roller to the second roller, and to thereafter again reverse the rotation direction of the image carrier such that the image carrier rotates in the first direction and transfer the toner from the second roller to the first roller and then from the first roller to the image carrier, wherein the control section further controls the transfer member to not contact the image carrier during the toner image formation in the external additive removal operation and to be brought to contact the image carrier during the transfer of the toner from the second roller to the first roller and then from the first roller to the image carrier in the external additive removal operation; and a collecting member that collects the toner that has moved from the first roller to the image carrier.

2. An image forming unit comprising:

an image carrier;

a first roller that is in contact with the image carrier and charges the image carrier;

a second roller that is in contact with the first roller and obtains toner from or supplies toner to the first roller;

an exposure section that irradiates the charged image carrier with light to form an electrostatic latent image thereon;

a development section that develops the electrostatic latent image with the toner to form a toner image;

a transfer section that transfers the toner image to a transfer member;

a control section that controls the image forming unit, in an external additive removal operation, to form a toner image on the image carrier, to subsequently reverse a rotation direction of the image carrier such that the image carrier rotates in a direction opposite a first direction of rotation and transfer toner from the toner image from the image carrier to the first roller and then from the first roller to the second roller, and to thereafter again reverse the rotation direction of the image carrier such that the image carrier rotates in the first direction and transfer the toner from the second roller to the first roller and then from the first roller to the image carrier, wherein the control section further controls the rotation of the first roller and the second roller during the transfer of toner from the toner image from the image carrier to the first roller and then from the first roller to the second roller in the external additive removal operation such that the first roller and the second roller rotate in the same direction or such that the first roller and the second roller rotate in opposite directions at different rotational speeds; and a collecting member that collects the toner that has moved from the first roller to the image carrier.

* * * * *